US008851160B2

(12) United States Patent
Stolboushkin

(10) Patent No.: US 8,851,160 B2
(45) Date of Patent: Oct. 7, 2014

(54) PERCUSSION OPERATED FIRING MECHANISM FOR PERFORATION OF WELLBORES AND METHODS OF USING SAME

(75) Inventor: Eugene Stolboushkin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 361 days.

(21) Appl. No.: 13/299,134

(22) Filed: Nov. 17, 2011

(65) Prior Publication Data

US 2013/0126167 A1 May 23, 2013

(51) Int. Cl.
*E21B 43/116* (2006.01)
*E21B 43/1185* (2006.01)

(52) U.S. Cl.
CPC ..... *E21B 43/11855* (2013.01)
USPC ..... 166/55.2; 166/55

(58) Field of Classification Search
CPC .... E21B 43/11; E21B 43/116; E21B 43/1185
USPC ..... 166/297, 55, 55.2
See application file for complete search history.

(56) References Cited

U.S. PATENT DOCUMENTS 5,911,277 A * 6/1999 Hromas et al. ..... 166/297
7,819,198 B2 10/2010 Birckhead et al.

* cited by examiner

*Primary Examiner* — Brad Harcourt
(74) *Attorney, Agent, or Firm* — Greenberg Traurig, LLP

(57) ABSTRACT

Perforation guns comprise a firing head to activate an initiator which, in turn, causes detonation of perforation charges. The firing head comprises a firing pin in sliding engagement with a bore of a housing. An opening in the housing places the firing pin in fluid communication with a wellbore annulus when the perforation gun is disposed in the wellbore. A release mechanism maintains the firing pin in it is initial position. Upon being disposed in the desired location within the wellbore, the release mechanism is actuated allowing the firing pin to move within the bore. Hydrostatic pressure acts on the firing pin in a first direction that is determined by a bias provided by one end of the firing pin providing greater resistance to movement as compared to the other end. Movement of the firing pin causes the firing pin to strike the initiator causing detonation of the perforation charges.

19 Claims, 3 Drawing Sheets

PERCUSSION OPERATED FIRING MECHANISM FOR PERFORATION OF WELLBORES AND METHODS OF USING SAME

BACKGROUND

1. Field of Invention

The invention is directed to firing mechanisms for downhole tools and, in particular, to percussion operated firing mechanisms for perforation guns used in opened or cased wellbores.

2. Description of Art

Perforation of opened and cased wellbores using perforation charges is known. In general, perforating a well involves a special gun called a perforation gun that shoots several relatively small holes in the wellbore, e.g., the casing, the cement, or the formation itself, using explosive charges disposed on or within the perforation gun. The holes are formed in the side of the well opposite the producing zone. These communication tunnels or perforations can pierce the casing or liner, the cement around the casing or liner, or the formation. The perforations go through the casing, the cement, or the formation a short distance into the producing well formation. Well formations fluids, which can include oil, water, and gas, flow through these perforations and into the well.

The perforation gun can be run-in the wellbore on wireline or tubing. Firing of the explosives of the perforation gun are generally done by drop-bar, pressure, or by sending electronic signals to the perforation gun which activate an initiator which in turn detonates the perforation charges, such as through the use of detonation cord in communication with each perforation charge. Upon activation of the initiator, the explosives are detonated to shoot the holes in the wellbore.

SUMMARY OF INVENTION

Broadly, the firing heads and perforation guns disclosed herein comprise a percussion initiator comprising a firing pin disposed in sliding engagement within an inner wall surface of a tubular member. An opening in the outer and inner wall surfaces of the tubular member places a portion of the firing pin in fluid communication with the wellbore annulus. Disposed below the firing pin at a lower end of the tubular member is an initiator that is operatively associated with the explosive charge(s) of the perforating gun. The filing pin includes seals in sliding engagement with the inner wall surface of the tubular member. The seals are initially disposed above and below the opening. The seals below the opening, i.e., toward the initiator, are smaller than the seals toward the upper end, thereby creating a bias of movement toward the initiator.

In certain embodiments, a release mechanism maintains the firing pin in its initial position until being actuated to release the firing pin. In one specific embodiment of operation, actuation of the release mechanism comprises a preprogrammed signal sent from the surface of the wellbore to the release mechanism. Upon receiving the preprogrammed signal, the release mechanism actuates causing the firing pin to be released. The firing pin then moves in a first direction to strike the initiator due to hydrostatic pressure within the wellbore annulus acting on the firing pin in the first direction, i.e., in the direction of the bias. Upon striking the initiator, the initiator is activated setting off a chain reaction in which the perforation charges are detonated.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

Figure 1:
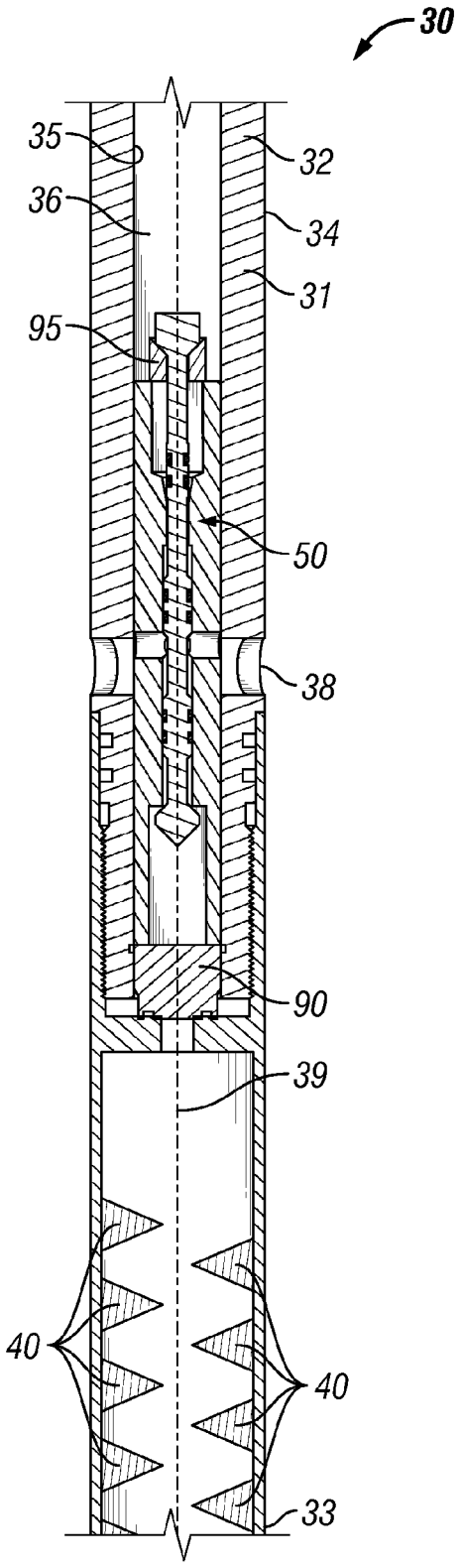
FIG. 1 is a partial cross-sectional view of one specific embodiment of a perforation gun as disclosed herein.
Figure 2:
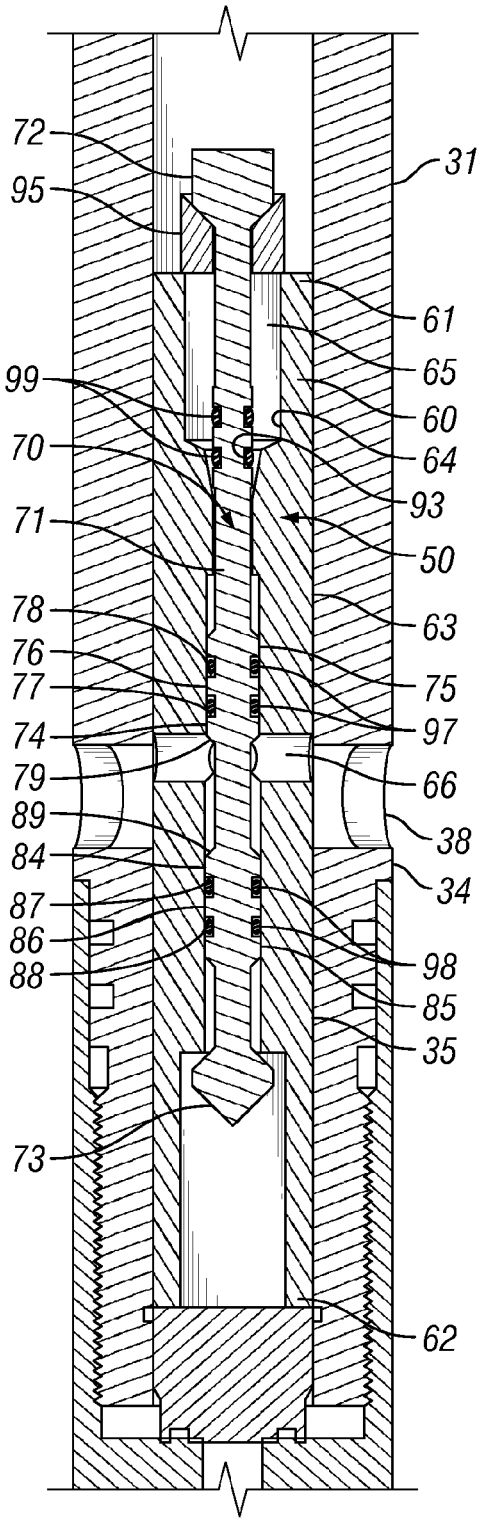
FIG. 2 is an enlarged partial cross-sectional view of the perforation gun of FIG. 1 showing one specific firing head disclosed herein.

Referring now to FIGS. 1-2, perforation gun 30 comprises a tubular member 31 having upper end 32, lower end 33, outer wall surface 34, and inner wall surface 35 defining tubular member bore 36. Opening 38 is disposed through outer and inner wall surfaces 34, 35 placing tubular member bore 36 in fluid communication with an outside environment such as an annulus of a wellbore (not shown). As shown in FIGS. 1-2, opening 38 is disposed at an angle that is perpendicular to longitudinal axis 39 of tubular member 31.

Also included in perforation gun 30 are one or more perforating charges 40 disposed within bore 36 and oriented to expel an explosive force outwardly from tubular member 31 and into the wellbore, e.g., into the casing, liner, cement, or the formation itself, all of which are understood to meet the definition of wellbore as used herein.

Perforating charges 40 are operatively associated with and, thus, detonated by firing head 50 disposed within bore 36 of tubular member 31. In one embodiment, each perforating charge 40 is connection with a detonator cord, such as primer cord or other detonating cord or device known in the art (not shown) to facilitate detonation of the perforating charges 40. The detonation cord is operatively associated with an initiator, such as initiator 90 discussed in greater detail below, so that when the initiator is activated, the detonation cord is activated causing the perforating charges 40 to explode and expel an explosive force outwardly from tubular member 31 and into the wellbore.

Referring to the embodiment of FIGS. 1-2, firing head 50 comprises housing 60 having upper end 61, lower end 62, outer wall surface 63, and inner wall surface 64 defining bore 65. Opening 66 is disposed through outer and inner wall surfaces 63, 64 placing housing bore 65 in fluid communication with opening 38 of tubular member 31. As shown in FIGS. 1-2, opening 66 is disposed at an angle that is perpendicular to longitudinal axis 39 (FIG. 1) of tubular member 31.

Disposed within housing bore 65 in sliding engagement with housing inner wall surface 64 is firing pin 70. Firing pin 70 comprises shaft 71 having upper end 72, lower end 73 and one or more portions in sealing and sliding engagement with inner wall surface 63 of housing 60. As shown in FIGS. 1-2, lower end 73 comprises tapered surfaces forming a point to facilitate activation of initiator 90 as discussed in greater detail below. It is to be understood, however, that lower end 73 is not required to be tapered, but can any other desired or necessary shape to activated initiator 95. For example, lower end 73 can be flat.

In the embodiment of FIGS. 1-2, firing pin 70 comprises three upper portions in sealing and sliding engagement with inner wall surface 64 of housing 60 disposed above opening 66 when firing pin 70 is in its initial, run-in, position (FIGS. 1-2), and three lower portions in sealing and sliding engagement with inner wall surface 64 of housing 60 disposed below opening 66 when firing pin 70 is in its initial, run-in, position (FIGS. 1-2). Despite being shown as having three upper and three lower portions, it is to be understood that firing pin 70 can have a single upper portion and single lower portion.

The three upper portions are referred to as first upper portion 74 which is located closest to opening 66, second upper portion 75 which is located closest to upper end 72, and third upper portion 76 which is disposed between first upper portion 74 and second upper portion 75. First upper gap 77 is disposed between first upper portion 74 and third upper portion 76. Second upper gap 78 is disposed between second upper portion 75 and third upper portion 76. Seals 97, such as elastomeric o-rings, are disposed within first and second upper gaps 77, 78.

The three lower portions are referred to as first lower portion 84 which is located closest to opening 66, second lower portion 85 which is located closest to lower end 73, and third lower portion 86 which is disposed between first lower portion 84 and second lower portion 85. First lower gap 87 is disposed between first lower portion 84 and third lower portion 86. Second lower gap 88 is disposed between second lower portion 85 and third lower portion 86. Seals 98, such as elastomeric o-rings, are disposed within first and second lower gaps 87, 88.

In one specific embodiment, first and second upper gaps 77, 78 are larger than first and second lower gaps 87, 88 so that seals 97 within first and second upper gaps 77, 78 are larger than seals 98 and, thus, provide greater frictional force along inner wall surface 64 as compared to seals 98. As a result, firing pin 70 is downwardly bias such that fluid pressure flowing through openings 38, 66 and acting on upper surface 89 of second lower portion 85 will cause firing pin 70 to move downward (assuming firing pin 70 is not being retained in its initial or run-in position by a release mechanism) because of a lesser frictional force (coefficient of friction) is present between the smaller seals 98 disposed within first and second lower gaps 87, 88.

In another particular embodiment, seals 99 are disposed within grooves 93 disposed toward upper end 72 of firing pin 70. The location of seals 99 is to prevent fluid leakage into the upper portion of bore 65 when seals 97 are disposed below opening 66 during firing. In addition, the location of seals 97, 98 are such that when seals 98 are no longer in sliding engagement with inner wall surface 64 of bore 65, fluid is permitted to leak into the lower portion of bore 65 above initiator 95 causing lower end 73 of firing pin 70 to moved away from contact with initiator 95. Thus, in the event that initiator does not activate, perforation gun 30 can be removed from the wellbore with a decreased likelihood that the initiator will be activated causing the perforation charges to detonate.

Figure 3:
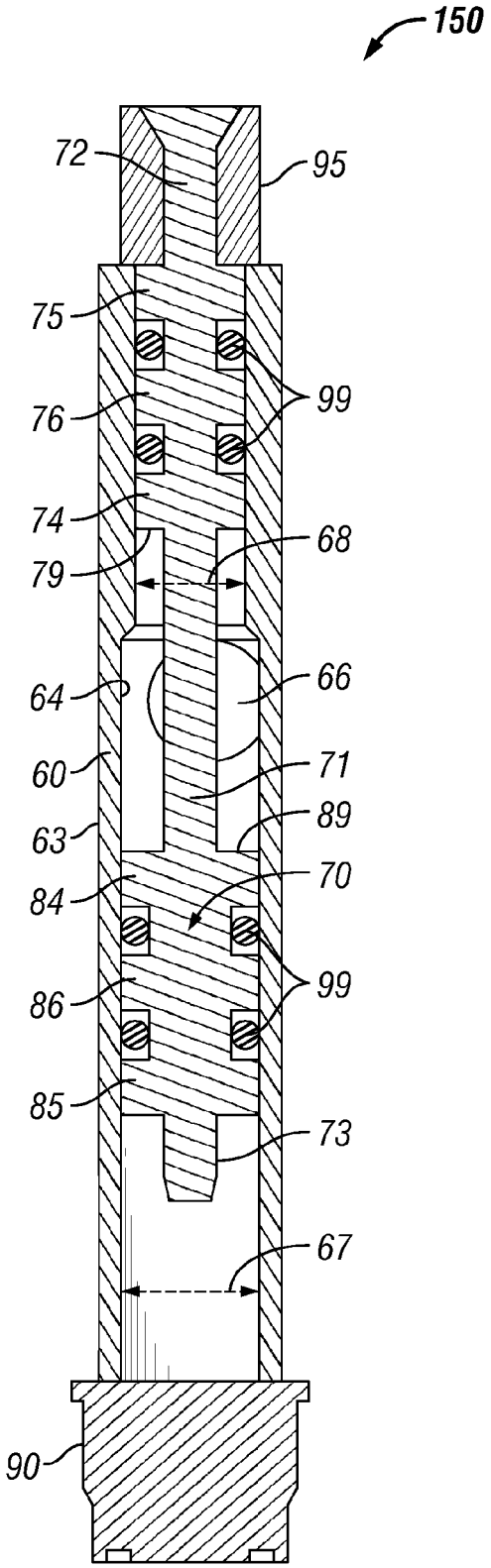
FIG. 3 is an enlarged cross-sectional view of another specific embodiment of a firing head disclosed herein.

In an alternative embodiment shown in FIG. 3, firing head 150 comprises housing bore 65 having first diameter 67 disposed below opening 66 and second diameter 68 disposed above opening 66. In this embodiment, first diameter 67 is larger than second diameter 68 and, therefore, first, second and third lower portions 84, 85, 86 include a larger outer diameter as compared to the outer diameters of first, second, and third upper portions 74, 75, 76, thereby providing a larger surface area of upper surface 89 of second lower portion 85 as compared to the surface area of lower surface 79 of second upper portion 75. Accordingly, firing pin 70 is downwardly biased because fluid pressure acting on upper surface 89 of second lower portion 85 is greater than the fluid pressure acting on lower surface 79 of second upper portion 75 so that firing pin 70 can move downward. In this embodiment, seals 99 can all be the same size.

In other embodiments, the downward movement bias of firing pin 70 is established by a contact area of one or more lower portions with inner wall surface 64 of housing 60 being smaller than a contact area of one or more upper portions with inner wall surface 64. In still other embodiments, the downward bias is provided by the contact area of one or more lower portions with inner wall surface 64 of housing 60 having a lower coefficient of friction than the contact area of one or more upper portions with inner wall surface 64. Thus, the downward bias can be provided by any method or device known in the art which results in firing pin 70 being moved in the direction toward the initiator due to hydrostatic pressure acting on firing pin 70.

Disposed at lower end 62 of housing 60 is initiator 90. Initiator 90 is operatively associated with one or more perforation charges 40 through known methods and devices in the art. Upon activation of initiator 90, the one or more perforation charges 40 are detonated causing a force to be expelled outward from perforation gun 30 and into the wellbore.

In one specific embodiment, release mechanism 95 is disposed at upper end 72 of housing 60. Release mechanism 95 maintains firing pin 70 in its initial, or run-in, position (FIGS. 1-3) until perforation gun 30 is disposed within the wellbore at the desired location. Thus, release mechanism 95 is sufficient to prevent firing pin 70 from moving, even when sufficient fluid pressure is acting on firing pin 70 through openings 38, 66. In one particular embodiment, release mechanism 95 comprises an electronic activated release mechanism. One suitable electronically activated release mechanism is disclosed in U.S. Pat. No. 7,819,198 B2, which is incorporated by reference herein in its entirety.

In one specific embodiment, the electronically activated release mechanism 95 is connected to an electronics package located downhole as part of perforation gun 30. For example, the electronics package monitors pressure, temperature, vibration, magnetic sensors, other means of communicating pressure downhole, and the like so that the release signal is determined by the programming of the electronics package. The electronics package receives a firing signal for inputs such as surface-applied pressure pulses, vibration of the drill string, temperature, magnetic sensors, and a combination of these and other methods. When the electronics packages senses a preprogrammed release signal, such as pressure pulse sequences, the electronics packages sends a signal to the electronic release mechanism 95 to release firing pin 70. As a result, firing pin 70 is propelled in a downward direction into initiator 90 due to hydrostatic pressure acting on firing pin 70. Firing pin 70 attains a sufficient velocity to engage or strike initiator 90 with sufficient energy to cause detonation of initiator 90. Initiator 90 then begins the explosive train contained within perforating gun 30 in the same manner as current perforation guns.

In another embodiment, the electronics packages is located at the surface of the well and is activated by sensing a release signal similarly to the embodiment discussed above. In this type of embodiment, the electronics package located at the surface is in electrical contact with the release mechanism located downhole.

In one specific operation of the perforation guns and firing heads disclosed herein, the perforation gun is loaded with the desired or necessary number and arrangement of perforation charges for perforating the wellbore. Operatively associated with the perforation charges is a percussion initiator. The initiator is disposed at a lower end of a tubular member. Disposed within the tubular member is the firing head. The firing head comprises a firing pin in sliding engagement with the inner wall surface of the tubular member. In one specific embodiment, the firing head is operatively associated with a release mechanism that is operatively associated with an electronics package that is preprogrammed to send a release signal to the release mechanism at a predetermined stimulus, e.g., pressure, temperature, or the like.

The perforation gun is run-in the wellbore to the desired location. Thereafter, the release mechanism is actuated thereby allowing the firing pin to move within the tubular member. Hydrostatic pressure within the wellbore annulus acts on the firing pin causing the firing pin to move toward the initiator at a velocity sufficient to activate or ignite the initiator. The firing pin strikes the initiator which in turn detonates the perforation charges. In one particular embodiment, the release mechanism is actuated by an electronic signal sent from electronics located at the wellbore surface by an operator operating the electronics.

In another specific embodiment, a time delay is programmed into the release mechanism so that the firing pin is not released until a predetermined amount of time has passed from the moment the release mechanism receives the from the operator the signal actuating the release mechanism.

It is to be understood that the invention is not limited to the exact details of construction, operation, exact materials, or embodiments shown and described, as modifications and equivalents will be apparent to one skilled in the art. For example, openings 38, 66 are not required to be in complete alignment as shown in FIGS. 1-2. Nor are openings 38, 66 required to be disposed at an angle that is perpendicular to the longitudinal axis of the tubular member. To the contrary, one or both of openings 38, 66 can be disposed at another angle relative to the longitudinal axis of the tubular member. In addition, the release mechanism is not required to be electronically activated, nor is it required to be disposed at the location shown in FIGS. 1-3. Moreover, the release mechanism is not required to send an electronic signal. Instead, the release mechanism can be a mechanical device located on the perforation gun, such as a rupture disk or shear pin that breaks at a predetermined pressure. Breaking of the rupture disk permits fluid pressure to flow into the housing bore and act on the firing pin. Further, the frictional force of the firing pin along the inner wall surface of the housing bore is not required to be provided by an elastomeric seal such as an o-ring. Instead, the seal or seals can be metal-to-metal seals where the downward bias is determined by the contact surface area of the firing pin with the inner wall surface. For example, the lower portion of the firing pin could have a small contact surface area as compared to the upper portion of the firing pin. Alternatively, all of the seals can be the same size, however, the bias is provided by having more seals initially disposed above the opening than disposed below the opening. Additionally, although downward direction is used herein to describe the direction of movement of the firing pin, it is to be understood that the embodiments disclosed herein can be reversed so that the firing pin moves in an upward direction. Moreover, it is to be understood that the term "wellbore" is to be given its broadest possible meaning to include any component of a wellbore, e.g., the casing, the cement, the liner, the formation itself, and any other component through which a perforation charge creates a passage. In addition, the upper and lower gaps disposed on the firing pin are not required. Further, when present, seals are not required to be placed within upper and lower gaps. Additionally, the shaft of the firing pin is not required to have an upper portion. Instead, the shaft can have a lower portion upon which hydrostatic pressure acts the upper end of the firing pin can be disposed through a hole at the top of the housing. To prevent leakage through this hole, the shaft can be in sliding engagement with the hole and one or more seals or other devices can be disposed within the hole. Accordingly, the invention is therefore to be limited only by the scope of the appended claims.

What is claimed is:

1. A firing mechanism for a downhole perforation gun, the firing mechanism comprising:

a tubular member having an upper end, a lower end, an outer wall surface, and an inner wall surface defining a bore;

an opening disposed in the inner and outer wall surfaces and in fluid communication with the bore;

an initiator disposed at the lower end of the tubular member, the initiator being operatively associated with a perforation charge;

a firing pin disposed within the bore, the firing pin comprising an initial position, a firing position, a shaft having a firing pin lower end, a lower middle portion, a lower end portion, a first lower gap, and a second lower gap, the lower middle portion and lower end portion being in sliding engagement with the inner wall surface, the first lower gap being disposed between the lower portion and the lower middle portion and the second lower gap being disposed between the lower middle portion and the lower end portion, a firing pin upper end, a lower portion in sliding engagement with the inner wall surface of the tubular member, the lower portion having an upper surface in fluid communication with the opening, the firing pin having a bias of movement from the initial position to the firing position; and a release mechanism operatively associated with the firing pin, the release mechanism maintaining the firing pin in the initial position until actuated, wherein actuation of the release mechanism frees the firing pin to slide along the inner wall surface of the tubular member toward the firing position at which the initiator is activated by the firing pin contacting the initiator.

2. The firing mechanism of claim 1, wherein a first lower sealing element is disposed within the first lower gap and a second lower sealing element is disposed in the second lower gap.

3. A downhole perforation gun comprising:

a tubular member having a tubular member upper end, a tubular member lower end, a tubular member outer wall surface, and a tubular member inner wall surface defining a tubular member bore;

a tubular member opening disposed in the tubular member inner and outer wall surfaces and in fluid communication with the tubular member bore;

at least one perforation charge disposed within the tubular member bore; and a firing head disposed within the bore of the tubular member, the firing head having a housing having an upper housing end, a lower housing end, a housing outer wall surface, and a housing inner wall surface defining a housing bore, an opening disposed in the housing inner and outer wall surfaces and in fluid communication with the tubular member bore and the housing bore, an initiator disposed at the lower housing end, the initiator being operatively associated with at least one of the at least one perforation charges, a firing pin disposed within the housing bore, the firing pin comprising an initial position, a firing position, a shaft having a firing pin lower end, a firing pin upper end, an upper portion in sliding engagement with the inner wall surface of the housing member, and a lower portion in sliding engagement with the inner wall surface of the housing member, the lower portion comprising a lower portion coefficient of friction of the sliding engagement of the lower portion with the housing inner wall surface that is less than an upper portion coefficient of friction of the sliding engagement of the upper portion with the housing inner wall surface, thereby providing a bias of movement from the initial position to the firing position, and a release mechanism operatively associated with the firing pin, the release mechanism maintaining the firing pin in the initial position until actuated, wherein actuation of the release mechanism frees the firing pin to slide along the inner wall surface of the tubular member toward the firing position at which the initiator is activated by the firing pin contacting the initiator.

4. The perforating gun of claim 3, wherein the lower portion comprises an upper surface in fluid communication with the housing opening, the upper surface having a first surface area, and the upper portion comprises a lower surface having a second surface area, the first surface area being larger than the second surface area.

5. The perforating gun of claim 3, wherein the shaft of the firing pin further comprises a lower middle portion, a lower end portion, a first lower gap, and a second lower gap, the lower middle portion and lower end portion being in sliding engagement with the inner wall surface, the first lower gap being disposed between the lower portion and the lower middle portion and the second lower gap being disposed between the lower middle portion and the lower end portion.

6. The perforating gun of claim 5, wherein the shaft of the firing pin further comprises an upper middle portion, an upper end portion, a first upper gap, and a second upper gap, the upper middle portion and upper end portion being in sliding engagement with the inner wall surface, the first upper gap being disposed between the upper portion and the upper middle portion and the second upper gap being disposed between the upper middle portion and the upper end portion.

7. The perforating gun of claim 6, wherein a first upper sealing element is disposed within the first upper gap, a second upper sealing element is disposed in the second upper gap, a first lower sealing element is disposed within the first lower gap and a second lower sealing element is disposed in the second lower gap.

8. The perforating gun of claim 3, wherein the housing bore comprises a first housing inner diameter disposed above the housing opening and a second housing inner diameter disposed below the housing opening, the second housing inner diameter being larger than the first housing inner diameter.

9. A method of activating a perforation charge of a perforation gun within a wellbore, the method comprising the steps of:

(a) disposing within a wellbore a perforation gun comprising a tubular member having an upper end, a lower end, an outer wall surface, and an inner wall surface defining a bore, an opening disposed in the inner and outer wall surfaces and in fluid communication with the bore, and a firing head, the firing head having a movable firing pin releasably secured in an initial position by a release mechanism, the firing pin having a lower portion in sliding engagement with the inner wall surface of the tubular member, the lower portion having an upper surface in fluid communication with the opening, and an upper portion in sliding engagement with the inner wall surface of the tubular member, the upper portion having a lower surface in fluid communication with the opening;

(b) actuating the release mechanism causing the firing pin to be released, thereby allowing the firing pin to move from the initial position in a first direction;

(c) moving the firing pin in the first direction due to hydrostatic pressure disposed within an annulus of the wellbore acting on the firing pin in the first direction; and (d) striking with the firing pin an initiator disposed within the bore of the perforation gun causing activation of the initiator, the activation of the initiator causing at least one perforation charge to be detonated, wherein detonation of the perforation charge causes a force to be expelled from the perforation charge into the wellbore.

10. The method of claim 9, wherein, during step (a), hydrostatic pressure acts on the firing pin in the first direction and the firing pin is maintained in an initial position by an electronically activated release mechanism.

11. The method of claim 10, wherein during step (b) the firing pin is released by an electronic signal actuating a release mechanism operatively associated with the firing pin.

12. A firing mechanism for a downhole perforation gun, the firing mechanism comprising:

a tubular member having an upper end, a lower end, an outer wall surface, and an inner wall surface defining a bore;

an opening disposed in the inner and outer wall surfaces and in fluid communication with the bore;

an initiator disposed at the lower end of the tubular member, the initiator being operatively associated with a perforation charge;

a firing pin disposed within the bore, the firing pin comprising an initial position, a firing position, a shaft having a firing pin lower end, a firing pin upper end, a lower portion in sliding engagement with the inner wall surface of the tubular member, the lower portion having an upper surface in fluid communication with the opening, an upper portion in sliding engagement with the inner wall surface of the tubular member, the upper portion having a lower surface in fluid communication with the opening, the firing pin having a bias of movement from the initial position to the firing position; and a release mechanism operatively associated with the firing pin, the release mechanism maintaining the firing pin in the initial position until actuated, wherein actuation of the release mechanism frees the firing pin to slide along the inner wall surface of the tubular member toward the firing position at which the initiator is activated by the firing pin contacting the initiator.

13. The firing mechanism of claim 12, wherein the lower surface comprises a first surface area and the upper surface comprises a second surface area, the first surface area being larger than the second surface area thereby biasing the firing pin for movement from the initial position toward the firing position.

14. The firing mechanism of claim 12, wherein the upper portion comprises an upper contact area in sliding engagement with the inner wall surface and the lower portion comprises a lower contact area in sliding engagement with the inner wall surface, the upper contact area being greater than the lower contact area thereby biasing the firing pin for movement from the initial position toward the firing position.

15. The firing mechanism of claim 12, wherein the upper portion comprises an upper contact area in sliding engagement with the inner wall surface and the lower portion comprises a lower contact area in sliding engagement with the inner wall surface, the upper contact area having an upper portion coefficient of friction that is greater than a lower portion coefficient of friction of the lower portion thereby biasing the firing pin for movement from the initial position toward the firing position.

16. The firing mechanism of claim 12, wherein the shaft further comprises an upper middle portion, an upper end portion, a first upper gap, and a second upper gap, the upper middle portion and upper end portion being in sliding engagement with the inner wall surface, the first upper gap being disposed between the upper portion and the upper middle portion and the second upper gap being disposed between the upper middle portion and the upper end portion.

17. The firing mechanism of claim 16, wherein a first upper sealing element is disposed within the first upper gap and a second upper sealing element is disposed in the second upper gap.

18. The firing mechanism of claim 17, wherein the shaft further comprises a lower middle portion, a lower end portion, a first lower gap, and a second lower gap, the lower middle portion and lower end portion being in sliding engagement with the inner wall surface, the first lower gap being disposed between the lower portion and the lower middle portion and the second lower gap being disposed between the lower middle portion and the lower end portion.

19. The firing mechanism of claim 12, wherein the bore comprises a first inner diameter disposed above the opening and a second inner diameter disposed below the opening, the second inner diameter being larger than the first inner diameter.

* * * * *